US006383706B1

(12) United States Patent
Kumar et al.

(10) Patent No.: US 6,383,706 B1
(45) Date of Patent: May 7, 2002

(54) PARTICULATE SMOOTHING PROCESS

(75) Inventors: Samir Kumar, Penfield; Juan A. Morales Tirado, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 8 days.

(21) Appl. No.: 09/615,819

(22) Filed: Jul. 13, 2000

(51) Int. Cl.[7] ..... G03G 9/08; B02C 19/06

(52) U.S. Cl. ..... 430/137.18; 241/5; 241/25; 430/137.2

(58) Field of Search ..... 241/5, 25; 430/137.18, 430/137.2

(56) References Cited

U.S. PATENT DOCUMENTS

| | | | | | |
|---|---|---|---|---|---|
| 3,650,798 | A | | 3/1972 | Case et al. | 117/21 |
| 4,209,550 | A | | 6/1980 | Hagenbach et al. | 427/27 |
| 4,233,387 | A | | 11/1980 | Mammino et al. | 430/137 |
| 4,288,519 | A | * | 9/1981 | Diamond et al. | 430/137.18 |
| 4,333,743 | A | | 6/1982 | Nojima | 51/298 |
| 4,935,326 | A | | 6/1990 | Creatura et al. | 430/108 |
| 5,412,185 | A | | 5/1995 | Sturman, Jr. et al. | 219/651 |
| 5,562,253 | A | * | 10/1996 | Henderson et al. | 241/5 |
| 5,695,132 | A | * | 12/1997 | Gorzka et al. | 241/5 |

* cited by examiner

*Primary Examiner*—John Goodrow
(74) *Attorney, Agent, or Firm*—Robert Thompson

(57) ABSTRACT

An apparatus including: a grinder adapted to grind toner particles; a classifier in communication with the grinder adapted to separate sized toner particles from unsized toner particles; a conduit in communication with the classifier which conduit is adapted to convey the sized toner particles away from the grinder; a heater adapted to heat and smooth the surface of the sized toner particles received from the conduit; and a particle separator adapted separate the resulting mixture of smooth surface toner particles and debris particles received from the heater.

17 Claims, 4 Drawing Sheets

PARTICULATE SMOOTHING PROCESS

REFERENCE TO COPENDING APPLICATIONS AND ISSUED PATENTS

Attention is directed to commonly owned and assigned U.S. Pat. No. 4,935,326, issued Jun. 19, 1990, to Creatura, et al.

Attention is directed to commonly owned and assigned copending applications U.S. Ser. No. 09/387,210, filed Aug. 31, 1999, pending which discloses a process comprising: mixing carrier cores and a polymer; heating the resulting mixture with a non-contact induction heater to melt the polymer and fuse the polymer to the carrier core particles; and cooling the resulting coated carrier particles; U.S. Pat. No. 6,194,117, filed Aug. 26, 1999, which discloses a process comprising: blending carrier particles in a fluidized bed jet mill and continuously separating fine particles formed therein from the resulting blended carrier particles; and U.S. Ser. No. 09/409,139, filed Sep. 30, 1999, pending which discloses an article comprising: a conduit adapted for transporting particulate material from the first end to the second end of the conduit via an interior hollow chamber, including: a gas impermeable outer wall; a gas permeable inner wall; a compressed gas inlet nozzle which traverses the outer wall; a gas distribution chamber situated between the outer wall and the inner wall; and a gas pressure source attached to the gas inlet nozzle which communicates gas pressure to the gas distribution chamber and the gas permeable inner wall.

The disclosure of the above mentioned patent and copending applications are incorporated herein by reference in their entirety. The appropriate components and processes of these patents may be selected for the toners, developers, and preparative processes of the present invention in embodiments thereof.

BACKGROUND OF THE INVENTION

The present invention relates to an apparatus and processes thereof for preparing toner particles for use, for example, in electrophotographic printing. More specifically, the invention relates to an apparatus and preparative processes for preparing toner particles with smooth surfaces.

A common shortcoming or problem associated with related prior art toner particle production methods using, for example, comminutive methodologies, that is, where a mixture of a resin and a pigment are melt mixed into a mass and thereafter chopped up and subsequently pulverized by grinding and thereafter classified to a relatively narrow range of particles sizes, is that the resulting toner particles are disadvantaged by, for example, the toner particles having a relatively rough or uneven surface characteristic. This uneven or rough surface characteristic can cause the toners to have a number of undesirable or disadvantageous properties. These negative properties include, for example, poor and uneven flow characteristics; uneven or irregular compression and packing characteristics; and irregular charging and discharging properties. These negative properties can degrade the quality of the developablity and imaging performance of the toner particles in various imaging processes and apparatuses. The problem of rough or irregular toner particle surfaces and concomitant negative attributes is not unique to particles obtained by comminutive methodologies and may also be associated with other toner formation process, such as the so-called "chemical toners" including emulsion-aggregation type toner particle formation processes where the toner is comprised of many smaller particles assembled into larger aggregates.

PRIOR ART

In U.S. Pat. No. 4,209,550, issued Jun. 24, 1980, to Hagenbach et al., there is disclosed coated carrier materials prepared by electrostatically attracting particles of a coating material to the surface of carrier cores and then heating the carrier materials causing the coating material to fuse to the carrier material forming an adherent coating thereon. The coating material is attracted to the carrier materials by (a) rolling carrier materials down an inclined plane while spraying the carrier materials with a coating material; (b) dropping carrier materials through a cloud chamber containing a cloud of coating material particles; and (c) solids blending a mixture of carrier materials and particles of coating material.

In U.S. Pat. No. 4,935,326, issued Jun. 19, 1990, to Creatura et al., there is disclosed a carrier and developer composition, and a process for the preparation of carrier particles with substantially stable conductivity parameters comprising: 1) providing carrier cores and a polymer mixture; 2) dry mixing the cores and the polymer mixture; 3) heating the carrier core particles and polymer mixture, whereby the polymer mixture melts and fuses to the carrier core particles; and 4) thereafter cooling the resulting coated carrier particles.

In U.S. Pat. No. 4,333,743, issued Jun. 8, 1982, to Nojima, there is disclosed a method of producing sandblasting abrasive materials, and the materials so produced, consisting of silica sand and/or slag, coated with a thermosetting resin by heat treatment, and the coating being then rendered unsoluble and unmeltable, by subsequent, separate heat treatment. The resin may contain a catalyst.

In U.S. Pat. No. 5,412,185, issued May 2, 1995, to Sturman et al., there is disclosed an induction heating method and apparatus for coating polymers onto electrically conductive fibers. This is accomplished with an apparatus having a mandrel for supporting a composite workpiece and a helical induction coil disposed around the mandrel. The mandrel, workpiece and induction coil are disposed in an autoclave. The mandrel is a hollow, porous member having a port formed therein which is connected to a vacuum. A vacuum bag is hermetically sealed on the mandrel so as to define an enclosure over the workpiece. A power source is connected to the induction coil and, when activated, causes the coil to generate an oscillating magnetic field lying along the longitudinal axis of the mandrel. The magnetic field induces heat-generating eddy currents in the fibers of the workpiece which are oriented orthogonally to the magnetic field.

In U.S. Pat. No. 3,650,798, issued Mar. 21, 1972, to Case et al., there is disclosed a method for the coating of running strands or webs with a thermoplastic protective layer. The successive steps comprise the application of a primer and the hot air current drying and curing of same supplemented by inductive heating. The temperature is next raised in two successive stages by inductive type heaters, the later stage while the strand or web is vertically traversing the length of a continuously replenished dense cylindrical bed of powdered vinyl polymer or the like. The replenishment as well as cooling of the powder is accomplished through a recirculatory arrangement powered by air nozzles. Alternate coating materials are proposed including polyolefins containing compounds of metal.

In U.S. Pat. No. 4,233,387, issued Nov. 11, 1980, to Mammino et al., there is disclosed electrostatographic coated carrier particles for use in the development of electrostatic latent images prepared by mixing carrier core materials with powdered thermoplastic resin particles having a size of between 0.1 micron and about 30 microns. The carrier core materials are mixed with the resin particles until the resin particles mechanically and/or electrostatically adhere to the core materials and the mixture is heated to a temperature of between 320° F. and 650° F., for between 120 minutes and 20 minutes so that the resin particles melt and fuse to the carrier core materials. The coated carrier particles are cooled, classified to the desired particle size, and mixed with finely-divided toner particles to form a developer mixture. The process is especially advantageous for coating carrier particles with resin materials having poor solubility characteristics.

The aforementioned patents are incorporated by reference herein in their entirety.

There remains a need for improved toner manufacturing processes, and particularly comminutive toner manufacturing processes that produce relatively smooth surface toner particles with superior particle properties, and development and imaging characteristics, especially for fine toner particles with a narrow size distribution and for color toners used in high fidelity digital imaging processes and equipment.

The apparatus, processes thereof, and the smooth surface toner particle products resulting therefrom, of the present invention are useful in many applications including imaging and printing processes, including color printing, for example, electrostatographic, such as in xerographic printers and copiers, including digital systems.

SUMMARY OF THE INVENTION

Embodiments of the Present Invention, Include:

An apparatus comprising:

a grinder adapted to grind toner particles;

a classifier in communication with the grinder adapted to separate sized toner particles from unsized toner particles;

a conduit in communication with the classifier which conduit is adapted to convey the sized toner particles away from the grinder;

a heater adapted to heat and smooth the surface of the sized toner particles received from the conduit; and a particle separator adapted separate the resulting mixture of smooth surface toner particles and debris particles received from the heater;

A process, accomplished in the aforementioned apparatus, comprising:

grinding toner particles comprising a resin component and a magnetic pigment;

separating classified toner particles from the resulting ground particles;

transporting the separated classified toner particles and heating the separated classified toner particles with a non-contact induction heater surrounding at least a portion of the conduit to partially melt the resin component and causing the surface of the toner particles to smooth; and optionally isolating the resulting smooth surface toner particles; and An apparatus comprising:

a housing;

a high intensity mixing tool within the housing adapted to mechanically fluidize and blend toner particles;

a conduit in communication with the housing, adapted to convey toner particles away from the housing and to a receiver; and an induction heater surrounding at least a portion of the housing adapted to heat and smooth the surface of the toner particles while the particles are fluidized and blended.

These and other embodiments are illustrated herein.

DETAILED DESCRIPTION OF THE INVENTION

The present invention provides, in embodiments:

An apparatus comprising:

a grinder adapted to grind toner particles;

a classifier in communication with the grinder adapted to separate, for example, the resulting ground or sized toner particles from unsized toner particles;

a conduit in communication with the classifier which conduit is adapted to convey the sized toner particles away from the grinder;

a heater adapted to heat and smooth the surface of the sized toner particles received from the conduit; and a particle separator adapted separate the resulting mixture of smooth surface toner particles and debris particles received from the heater.

Figure 1:
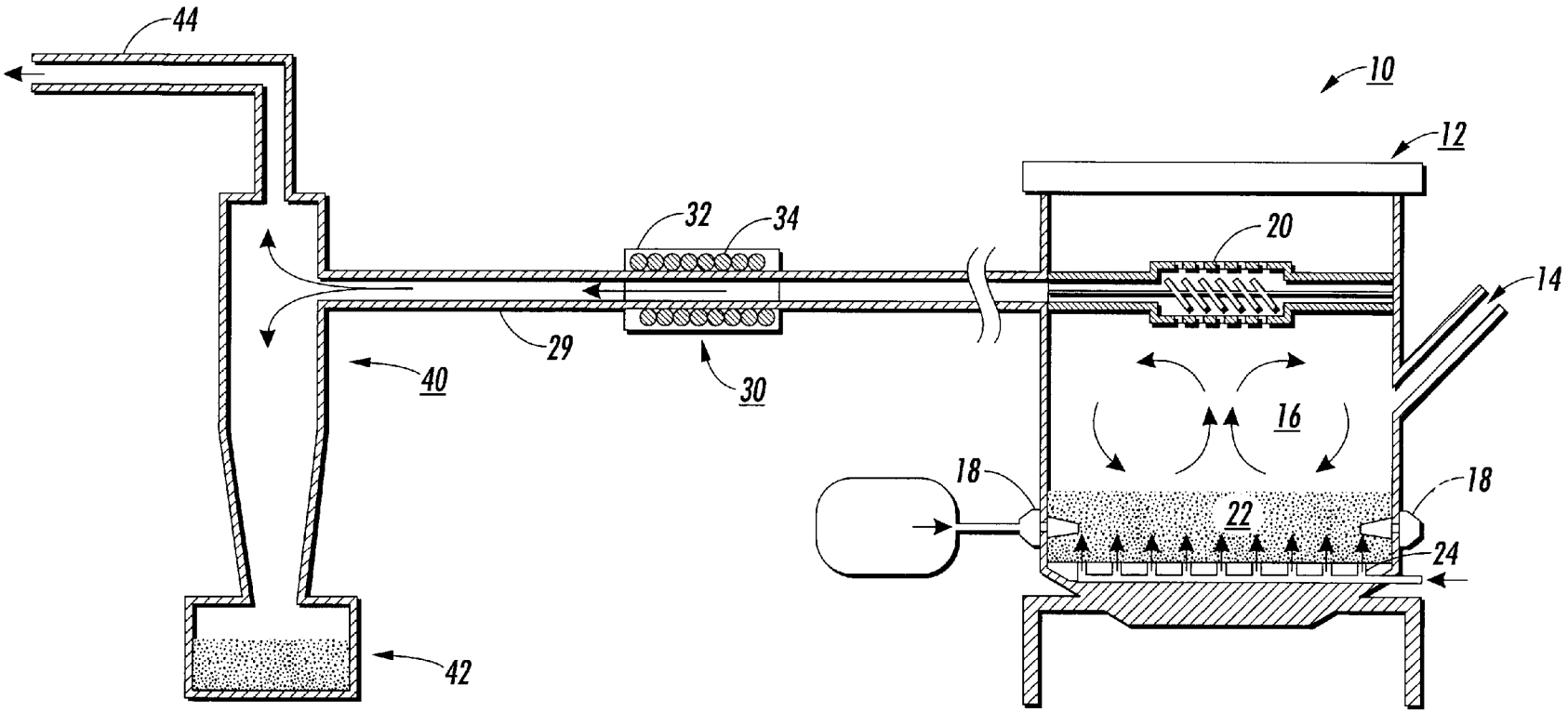
FIG. 1 illustrates in embodiments an apparatus of the present invention for preparing smooth surface toner particles.

Referring to FIG. 1 there is schematically illustrated in embodiments an apparatus and toner surface smoothing process of the present invention. The apparatus comprises a particle smoothing system or apparatus 10 which can include, for example, a typical fluidized bed jet mill grinder 12 that can include an optional particle inlet port 14, a grind chamber 16, compressed gas jet nozzles 18, a particle classifier 20, and a fluidized particle grinding area 22. The grinder 12 communicates classified particles from the classifier 20 to and through a conduit 29 and then to a heating or particle smoothing module 30 which includes a hollow tube 32. The conduit and the heating module can be separate components or can be integral components. Thus, for example, separate components are shown in FIG. 1, whereas as integral components the heating module could be coextensive with the conduit. Surrounding at least a portion of the tube 32 is a radio frequency induction heating coil 34. The coil heats, for example, single component toner particles from within the particles and as the particles pass through the non-contact heating zone generated by the coil 34 and within the tube 32, thereby softening or partially melting the resin of the magnetite and polymer toner mixture enabling some flow and redistribution of the resin in the toner particle matrix, especially of resin on the surface of the particles, and thereby enables smoothing of the surface of individual toner particles. In embodiments, the tube 32 can be adapted to continuously rotate, for example, by incorporating a motor and drive mechanism to the a freely rotatable heating module or tube 32, to provide additional motive force that prevents agglomeration and further urges coated toner particulate materials through the heated tube region tube. The particle heating and smoothing module 30 conveys the resulting smoothed toner particle stream to a particle separator module 40 wherein the desired smooth surface particulate product is separated from the "out of spec" debris product. The desired smoothed toner product, for example, can be collected in a product collector 42 while the undesired debris can be directed to, for example, a dust collector 44 or bag house(not shown) for recovery and possible recycling.

The heater can be a non-contact induction heater which surrounds at least a portion a portion of the conduit. The heater can be adapted to partially melt, that is to varying degrees or amounts, for example, from about 0.1 weight percent of the resin to about 80 weight percent of the resin, and preferably from about 0.1 to about 50 weight percent of the resin, and more preferably from about 0.1 to about 25 weight percent of the resin component of the sized toner particles being conveyed through the conduit to produce sized toner particles having a smooth surface, that is, a smoother surface compared to the surface of the sized toner particles before being heated in the heater. The heater can, for example, further include a rotary tube interposed in the conduit. The grinder can be, for example, an appropriately adapted and known fluidized jet mill, reference the aforementioned commonly owned copending application U.S. Ser. No. 09/383,937. The apparatus can further comprise at least one feed source of resin particles, magnetic pigment particles, or toner particles. The particle separator can comprise a first receiver for collecting the heavier smooth surface toner particles and a second receiver for collecting the lighter debris particles. The heater can heat the conveying toner particles at a temperature of from about 40 to about 500° C. as measured on the surface of the toner particles. The heating can be accomplished, for example in embodiments, preferably at a temperature of from 50 to 60° C. as measured on the surface of the toner particles. The heater can heat the conveyed toner particles for from about 0.1 second to about 5 minutes, preferably from about 0.1 second to about 2 minutes, and in embodiments, from about 8 seconds to 120 seconds.

The present invention provides, in embodiments a process, accomplished in the aforementioned apparatus or similar apparatuses, comprising:

- grinding toner particles comprising a resin component and a magnetic pigment;
- separating classified toner particles from the resulting ground particles;
- transporting the separated classified toner particles and heating the separated classified toner particles with a non-contact induction heater surrounding at least a portion of the conduit to partially melt the resin component and causing the surface of the toner particles to smooth; and
- optionally isolating the resulting smooth surface toner particles.

The resulting smooth surface toner particles can have a Normalized Surface Area Ratio of, for example, from about 2.5 to about 2.9 compared to an Area Ratio of about 2.8 to about 3.25 for toner particles prior to heating. A Normalized Surface Area Ratio is the ratio of BET Surface Area over the Layson Cell Coulter Counter Surface Area. The smooth surface toner particles can have a BET Surface Area of, for example, from about 1.20 $m^2/g$ to about 1.35 $m^2/g$ compared to BET Surface Area of from about 1.32 $m^2/g$ to about 1.5 $m^2/g$ for toner particles prior to heating. The Layson Cell Coulter Counter Area is in the range of 0.47 $m^2/g$ to about 0.50 $m^2/g$ before and after heating.

The process can further comprise, for example, blending the resulting smoothed surface toner particles with surface treated silica flow additives at about 1 weight percent to provide a Percent Cohesion value of, for example, from about 4 to about 6 compared to the Percent Cohesion value of about 9 to about 15 for non-heat treated toner particles with the same additives and in the same amounts. The process can further comprise, for example, blending the smooth surface toner particles with surface treated silica flow additives at about 1 weight percent to provide a Compression Ratio of about 0.30 compared to a Compression Ratio of about 0.33 for non-heat treated toner particles with the same additives and the same amounts. The process can further comprise, for example, blending the smooth surface toner particles with surface treated silica flow additives at about 1 weight percent to provide a triboelectric charging property of about 25 to about 27, for example, about 26 microcoulombs per gram, for a two component developer at about a 3 weight percent toner concentration compared to a triboelectric charging property of about 21 to about 24, for example about 23 microcoulombs per gram, for non-heat treated toner particles with the same additives and in the same amounts. In an example, toner particles were blended with about 1 weight percent TS-720 additive, reference the working Examples. The process can further comprise, for example, accomplishing the transporting and heating of at least a portion of the toner particles in the presence of a magnetic brush structure. The relative weight ratio of the resin to the magnetic pigment, in embodiments, can be from about 100:0.10 to about 1.0:10.0. The transport of the separated classified toner particles can be, depending on the desired volume and efficiencies, in amounts, for example, of from about 1 pound to about 10,000 pounds per hour. The toner particles can comprise, for example, a resin comprised of a styrene n-butylacrylate and a magnetic pigment comprised of magnetite wherein the relative weight ratio of the resin to the magnetic pigment is from about 90:10 to about 35:65, and in embodiments, more preferably from 60:40 to about 45:55.

Other suitable resins that can be selected for the toner resin include, for example, known polyamides, polyolefins, styrene acrylates, styrene methacrylate, styrene butadienes, polyesters, especially reactive extruded polyesters, crosslinked styrene polymers, epoxies, polyurethanes, vinyl resins, including homopolymers or copolymers of two or more vinyl monomers; and polymeric esterification products of a dicarboxylic acid and a diol comprising a diphenol.

A preferred magnetite is MTH-009F commercially available from TODA, Japan. Other magnetic pigments can be included or substituted and include for example, MAPICO BLACK, and other known and commercially available surface treated magnetites.

The present invention provides, in embodiments, an apparatus comprising:

- a housing, such as a durable walled mixing vessel or container;
- a high intensity mixing tool within the housing adapted to mechanically fluidize and blend toner particles;
- a conduit in communication with the housing, such as at or near the bottom of the housing, adapted to convey toner particles away from the housing and to a receiver particle collection bin; and
- an induction heater member, surrounding at least a portion of the housing, adapted to heat and smooth the surface of the toner particles while the particles are fluidized and blended within the housing.

The apparatus and the housing can further comprise a jacket adapted to surround at least a portion of the exterior of the housing and to provide insulation and temperature control or regulation to the heated contents of the housing.

The present invention provides, in embodiments, an apparatus comprising:

a chamber, such as a mixing vessel, adapted to fluidize toner particles;

a first porous member, such as a porous or sintered, ceramic or polymer material which is gas permeable, at the base the chamber adapted to admit a compressed gas stream to the chamber and to support the fluidized toner particles;

a second porous member, such as a porous or sintered, ceramic or polymer material which is gas permeable or suitable equivalent filter or screening media, situated, for example, at the top of the chamber and adapted to prevent the escape of fluidized toner particles, especially oversized materials, and to permit the escape of the compressed gas stream and optionally the escape of particulate material below a selected size range, for example, less than about 8 to about 15 microns; and a heater which surrounds at least a portion of the chamber adapted to heat, soften by partial melting, and thereby smooth the surface of the fluidized toner particles.

This apparatus can further comprise valves to control the flow rate of compressed gas into and out of the chamber and thereby provide uniform fluidization of the toner particles. The amount of toner particles inside the mixing vessel can be, for example, from about 5 pounds to about 700 pounds depending on the scale of the blender or whether the apparatus is operated on a batch, continuous, or semi-continuous basis.

A toner composition obtained by the processes of the present invention includes, for example: a resin comprised of styrene n-butylacrylate copolymer; a magnetic pigment comprised of MTH-009F magnetite commercially available from TODA, Japan; a volume average particle size of from about 6.6 to about 7.8 microns; a Normalized Surface Area Ratio of parent toner particles from about 2.5 to about 2.9; a BET Surface Area of parent toner particles from about 1.20 $m^2/g$ to about 1.35 $m^2/g$; a percent cohesion of toner particles when blended with 1% treated silica TS-720 from about 4 to about 6; and a Compression Ratio of toner particles of from about 0.30 to about 0.32, when blended with 1 weight percent treated silica TS-720, commercially available from Cabot Corporation. In embodiments the toner can further comprise, for example, a mixture of waxes PE130, a polyethylene wax commercially available from Hoechst Celanese Co., at 0.5 weight percent, and P200, a polypropylene wax commercially available from Mitsui Toatsu Chemical Company, Japan, at 3.0 weight percent, a charge control agent T77, commercially available from Hodogaya Chemical Co. Ltd., Japan, at 0.75 weight percent, and an external additives mixture of the aforementioned surface treated fumed silica TS-720 at 1.0 weight percent, and cerium oxide at 0.5 weight percent. The toner can be used in a variety of copying and printing devices including, for example, the Xerox Corporation Model DOCUMENT CENTER 220/230 machines and the DOCUMENT CENTER 332/340 Machines.

In embodiments, the processes and apparatuses of the present invention can include intermediate or final isolation and which isolation can include, for example, separating the smooth surface toner particles from low density debris subsequent to the heating smooth stage in the heating module. In embodiments, the process can further include continuously or intermittently vibrating the heated or isolated toner particles. The low density debris can include, for example, resin dust, magnetic pigment dust, or out-of-specification smooth surface toner particles. The smooth surface toner particles can be, for example, a single component toner composition or a two component toner composition. In embodiments, the resulting smooth surface toner particles can be combined with carrier particles to form, for example, a two component developer. In embodiments, the smoothed surface toners can be treated with surface additives simultaneously or sequentially, for example, with the inductively heated smoothing process of the present invention. The magnetic pigment can be any known magnetic pigment including known colorless magnetic materials. The magnetic pigment can be electrically conductive. The toner resin can be, for example, from one to a mixture of about 20 polymers or copolymers, and optionally one or more additives which improve inductive heating, triboelectric charging, electrical, Theological, hardness or brittleness, properties of the coating formed from the mixture of optional additive and polymer.

The conduit can be comprised of a material which is, for example, electrically and magnetically non-conductive; thermally insulating or non-insulating; and of low surface energy with respect to the resin, and the resulting smooth surface toner particles. The heating is preferably accomplished continuously. The conduit can be a rotary or stationary tube, such as a glass tube, a stainless steel tube, and the like tube materials. The tube can be, for example, oriented substantially horizontally, vertically, or at intermediate angles. The conduit can, in embodiments, be an aerated tube as disclosed in the aforementioned copending application U.S. Ser. No, 09/409,139, the disclosure of which is incorporated herein by reference in its entirety, such as a conduit adapted for transporting toner particulate material from the first end to the second end of the conduit via an interior hollow chamber, including: a gas impermeable outer wall; a gas permeable inner wall; a compressed gas inlet nozzle which traverses the outer wall; a gas distribution chamber situated between the outer wall and the inner wall; and a gas pressure source attached to the gas inlet nozzle which communicates gas pressure to the gas distribution chamber and the gas permeable inner wall.

As used herein non-contact heating is meant to describe increasing the thermal energy content of a workpiece or particle mass by means other than, for example, conduction, convection, or radiation. Thus thermal energy of a workpiece, such as, a small article or particle in the present invention, can be increased by heat generation within the workpiece itself, by for example induction, rather than heat transfer from without to the workpiece.

The uncoated core particles can be either or both electrically conductive and magnetic and are at least preferably electrically conductive. In embodiments the core is preferably magnetic.

The polymer can include for example magnetic fine particles, such as found in magnetic single component toner compositions, so that when the polymer particles are coated on to the surface of the magnetic particles, the resulting toner particles, that is, the combined magnetic-polymer particles are highly susceptible to efficient inductive heating and melting of the surface polymer material. Alternatively, or additionally, the polymer can include for example conductive fine particles, such as conductive carbon blacks, so that when the polymer particles are coated on to the surface of the conductive particles, the polymer particles are highly susceptible to efficient inductive heating and melting of the polymer.

The non-contact induction heater in embodiments surrounds and heats at least a portion of the resulting toner particle mixture.

The heating can be accomplished in batch mode, semi-continuously, or preferably continuously, in the case of large volume throughput or high efficiency processes. The rotary tube can be preferably comprised of a substantially non-conductive, non-magnetic materials. The thermal conductivity of the tube material, or alternatively, the heating section of the apparatus, that is where the induction coil is located, can be comprised of, for example, a substantially thermally insulative material to retain heat during the heating and smoothing process and the remainder of the tube can be comprised of a substantially thermally conductive material to remove any generated or latent heat, and for example, along with any additional cooling methods, such as water or glycol coolants. The rotary tube can also be comprised of materials that have complementary surface energies to additionally reduce the possibility of particle accumulation within the tube or conduit. The rotary tube can be configured in a variety of orientations and have a variety of geometries depending upon the coating characteristics desired. For example, the tube can be oriented substantially horizontal; substantially vertical, or at intermediate orientations, and which orientations are selected and adapted to suit the needs of a particular coating process and to optimize the desired coating results.

Although not wanting to be limited by theory it is believed that the combination of efficient mixing, fluidization, transport, heating, and cooling of the toner particle mixture, with or without the surface additives present can contribute to obtaining the desired smoothed surface toner particles with the desired physical and chemical properties.

In an alternative embodiment the foregoing apparatuses and processes can include, for example, continuously or intermittently vibrating or disturbing the conduit or transport portion of the apparatus, such as a conveyor belt or a rotary tube, with for example, an external vibrator or internal air knife, to provide for example, an additional parameter for regulating the extent and uniformity of the smoothness of the particle surfaces and to guard against rough or smooth resin particles from adhering to the transport device or against interparticle adhesion or agglomeration. Furthermore, the transport device, such as a belt conveyor or a rotary tube, can be equipped with, for example, contact surface coatings which have surface energies that can further minimize or eliminate the adherence of polymer or coated particles to the transport device. Materials such as TEFLON® and related non- or low-adhesion coatings can be adapted to the contact surfaces for the aforementioned coating application.

A salient aspect of the present invention which is believed to be responsible for the superior smoothness of toner particle surfaces and the efficiency of the process is that the non-contact inductive heating is highly specific and selectively heats the metallic additive particles causing the resin to melt and flow predominantly on the surface of the toner particles with limited interference or thermal competition with non-particle process surfaces, such as the transport and or mixing device.

The resin can be, for example, any thermoplastic, thermoset resin, or polymeric material which possesses sufficient melting and spreading properties with respect to the metallic particles and the toner particle surface. Examples of suitable resins include polyvinylidene fluoride, polyethylene, polymethylmethacrylate, copoly(ethylene-vinyl acetate), copoly(vinylidenefluoride-tetrafluoroethylene), tetrafluoroethylene, polyethylenes, polyesters, polyamides, polyurethanes, copolymers of methylmethacrylate and amine containing monomers, such as diethylamine ethylmethacrylate, diisopropylamine ethylmethacrylate, and t-butylamino ethylmethacrylate, fluorinated methacrylates, polyimides, polycarbonates, and the like materials, and mixtures thereof. The coating resin can optionally also be a composite of the polymer or copolymers, and other additives which additives improve, for example, inductive heating response of the metallic particle-resin mixture, triboelectric charging, electrical, Theological, and hardness or brittleness, and the like properties of the resultant composite. The composite can be produced by any known procedure, for example, melt mixing and then subsequently size reducing to a particle size of from about 0.1 to about 10 microns, and preferably less than about 5 microns in volume average diameter. Within the context of the present invention it will be readily understood by one of ordinary skill in the art that the terms "polymer" or "resin" can encompass one or more, that is a mixture of, resin materials which satisfy melting and flow condition on the toner particle surface of the inductively heated particles.

The present invention provides advantages and is preferred over conventional thermal particle smoothing systems for like particles in that, for example, highly directed application of thermal energy to the particle location can reduce the amount of agglomeration of particles in the coating process with the result that process yields and process efficiency can both be increased substantially. The present process enables the preparation of fully and substantially uniformly smooth surface toner particles and the like materials, and which processes can be achieved with lesser amounts of energy, due to reduced power losses, compared to conventional processes.

Embodiments of the present invention include incorporating a Venturi tube in the inductive heating zone to provide additional mixing forces to toner particle and to prevent agglomeration during heating.

In other embodiments, the present invention can include accomplishing either or both the mixing and heating of at least a portion of the toner particles in the presence of a magnetic brush structure, where the magnetic brush structure arises from the influence of external magnets or magnetic fields acting on at least a portion of the toner particles being smoothed. Alternatively the magnetic brush structure can be achieved by including carrier core type particles in the inductively heated zone of the apparatus. Although not desired to be limited by theory it is believed that the magnetic brush structure enhances the mixing and smoothing of the toner particles and can improve the uniformity and quality of the resulting smoothed toner surface. For example, there can be provided a series of alternating polarity magnets, or electrically on-off switchable magnetic equivalents, mounted in close proximity to the external surface of a rotary tube and which magnets can create an internal or inverted magnetic brush structure where chains of the carrier core particles or magnetic toner particles, with or without an admixture of coating polymer, form transient brush fibers and which fibers, for example, can radiate from the walls of the tube toward the rotational axis. The strength of the magnetic fields and the duration the cores are subjected to either or both magnetic brush conditions and inductive heating conditions can be readily controlled and thereby used to regulate the desired level of coating and limit or eliminate agglomeration of core particles or discrete chained core particles. Magnetic brush techniques are known in the art of xerographic development, reference for example, U.S. Pat. No. 5,933,683, the disclosure of which is incorporated herein by reference in its entirety, which patent and references therein provide additional background for magnetic brush structures which can be instructive for the adaptation of "inverted" magnetic brush structures as non-invasive and transient mixing structures to the apparatus and processes of the present invention.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Toner Preparation, Toner Smoothing, and Toner Classification

A toner composition was prepared in an extrusion device, available as ZSK92 from Werner-Pfleiderer, by adding thereto:

- 45.45 percent by weight of styrene n-butylacrylate copolymer resin, for example, XPA 4165 commercially available from Mitsui Toatsu Chemical Company, Japan;
- 50.3 percent by weight of MTH-009F magnetite available commercially from Toda, Japan;
- 0.75 percent by weight of T77 charge control agent commercially available from Hodogaya Chemical Co. Ltd., Japan;
- 0.5 percent by weight of PE-130 wax commercially available from Hoechst Celanese Co., USA; and
- 3.0 percent by weight of P200 wax commercially available from Mitsui Toatsu Chemical Company, Japan.

The melt mixture was extruded at a rate of 2,100 pounds per hour, and a melt temperature of about 245–270° F. The strands of extrudate exiting the extruder were cooled by a belt cooler with water running at 12 gallon/min and maintained at less than about 55° F. The resulting toner material was air dried.

The dried toner strands were subjected to grinding in a 200AFG Alpine Fluid Bed Grinder, enabling particles with a volume median diameter of from about 6.2 to about 7.2 microns as measured by a Coulter Counter. The 200AFG grinder was operated with a 3 to 4 millimeter nozzle at 100 psig pressure. The grinder wheel speed was set to obtain desired particle size. A 0.6 parts by weight surface additive, TS-720 surface treated silica commercially available from Cabot Corporation, was then continuously injected into the grind chamber during the size reduction process to yield a tightly bound uniform coverage of about 0.4 parts by weight of TS-720 on the toner surface. As the toner particles exit the grind chamber in a conduit, the particles are exposed to the heat treatment portion where the toner particles are exposed to the multi-turn helical induction heating coil, reference for example FIGS. 1 to 3. The induction heating of the toner is carried out as the toner exits the grind chamber. The fluidized toner particles in the conduit or outlet pipe are subjected to a varying electromagnetic field thereby locally heating the magnetite in toner and on toner surface to cause toner resin polymer on the toner surface to soften and slightly flow, for example from surface "peaks" or "ridges" into "valleys" or depressions to produce toner particles with a substantially smooth surface and reduced surface area compared to non-heat-treated toner particles. The induction heating unit can be, for example, an Ameritherm Nova Model 3 RF Induction Heater. The toner sample or stream can be heated at from about 73° F. to about 131° F. in less than about 1 second at, for example, 305 kHz.

Thereafter, the aforementioned toner particles are classified in a Donaldson Model B classifier for the purpose of removing fine particles, that is those particles with a volume median diameter of less than about 4 to about 5 microns. The classified toner was characterized for BET Surface Area and compared to the non-heat-treated toner. Another useful metric to measure the smoothness of toner surface is the Normalized Surface Area Ratio defined by the formula:

$$\text{Normalized Surface Area} = \text{BET Surface Area}/[6/(\text{particle density} \times D_{3,2})]$$

where $D_{3,2}$ is the Sauter Mean Diameter as measured by a Coulter Counter. A normalized surface area of 1 indicates a smooth sphere. The smaller the number the smoother the surface.

| | BET SA ($m^2/g$) | $D_{3,2}$ (microns) | Normalized Surface Area |
|---|---|---|---|
| Treated Toner | 1.36 | 7.01 | 2.80 |
| Control (non-heat-treated) | 1.53 | 6.91 | 3.11 |

This toner, a 5 pound load, was subsequently blended with a small-sized external additive package consisting of 1 percent by weight of a surface-treated silica with an 16 nanometer particle size CAB-O-SIL TS-720 from Cabot Corporation, with a surface treatment of amino oil and 0.5 percent by weight of cerium oxide, available from Mirek Corporation. The additives were blended onto the surface at 2,740 rpm for about 2 minutes with 80° F. jacket on a Henschel FM-10 blender. The prepared toner was measured for cohesion and compression ratio using the Hosokawa Powder Tester.

| | % Cohesion | Compression |
|---|---|---|
| Treated Toner | 5 | 0.30 |
| Control (non-heat-treated) | 12 | 0.33 |

The results indicate that the smooth surface toner when blended with additives has superior flow property compared to substantially the same but non-heat-treated toner.

To prepare a working developer the surface treated and smoothed toner was then combined with 97 percent by weight of a carrier and roll milled for about 30 minutes. The triboelectric charge was then measured at about 26 microcoulombs/gram ($\mu$C/g) in a known Faraday Cage apparatus compared to a triboelectric charge of 23 microcoulombs/gram for non-heat-treated control toner. The results suggest that the smooth surface toner when blended with equivalent amounts of additives has higher charge compared to the non-heat-treated toner. Additionally, the superior flow and charging properties of smooth surface toners of the present invention provides, for example, broader subsystem latitude and robustness in single component xerographic development processes used, for example, in Xerox Model Document Center 220, 230, 332 and 340 machines.

EXAMPLE II

Toner Preparation, Toner Smoothing, and Toner Classification

A toner composition was prepared in an extrusion device, available as ZSK92 from Werner-Pfleiderer, by adding thereto:

57.2 percent by weight of styrene n-butylacrylate copolymer resin, PSB-2931 commercially available from Hercules-Sanyo Inc., Wilmington, Del.;

40.0 percent by weight of MTH-009F magnetite commercially available from Toda, Japan;

0.7 percent by weight of TRH a known charge control agent; and 2.1 percent by weight of 660P wax supplied by SANYO Chemicals, Japan.

The melt mixture was extruded, ground, and classified as in Example I, and the resulting toner particles were analyzed.

| | BET SA ($m^2/g$) | $D_{3,2}$ (microns) | Normalized Surface Area |
|---|---|---|---|
| Treated Toner | 1.34 | 7.5 | 2.9 |
| Control (non-heat-treated) | 1.43 | 7.4 | 3.1 |

This toner was also subsequently blended with an external additive and measured for cohesion and compression ratio using the Hosokawa Powder Tester package as in Example I.

The melt mixture was extruded, ground, and classified as in Example I, and the resulting toner particles were analyzed.

| | % Cohesion | Compression |
|---|---|---|
| Treated Toner | 8 | 0.30 |
| Control (non-heat-treated) | 12 | 0.33 |

A working developer was prepared as in Example I with substantially the same result.

EXAMPLE III

Toner Preparation, Toner Smoothing, and Toner Classification

A toner composition was prepared in an extrusion device, available as ZSK92 from Werner-Pfleiderer, by adding thereto the identical ingredients and amounts as in Example I. The melt mixture was extruded, ground, and classified as in Example I.

Figure 2:
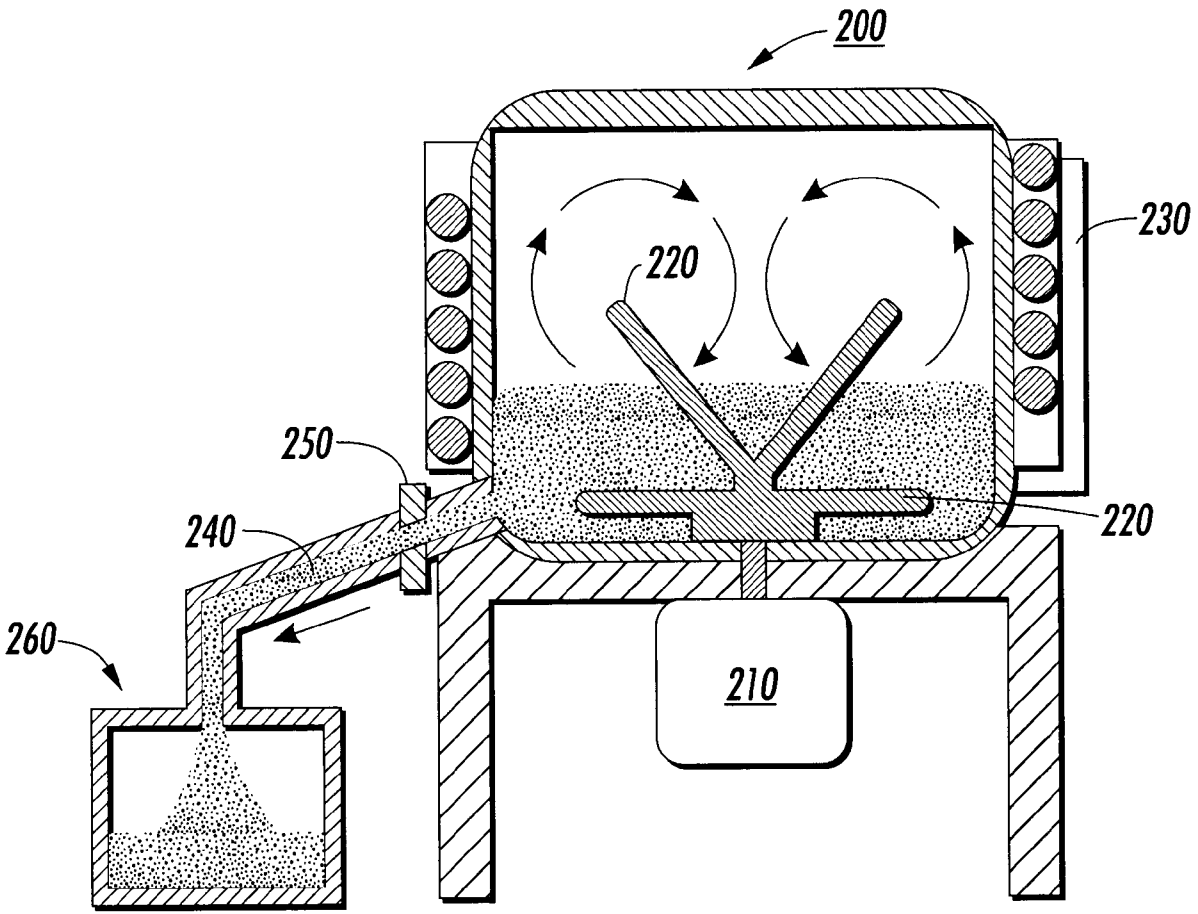
FIG. 2 illustrates in embodiments an apparatus of the present invention for preparing smooth surface toner particles.

Referring to, for example, FIG. 2, the classified toner (5 pounds) was placed in a modified high intensity blender (200) equipped with a drive motor(210), such as Henschel Blender FM-10, where the toner particles are mechanically fluidized by the mixing tools or rotor blades(220). The induction heating coil(230) is placed externally around the blender chamber walls and regulated by an appropriate power supply(not shown). The toner can be mechanically fluidized, for example, at about 2,700 rpm for about 30 seconds while the induction heating coil inductively heats the magnetite contained in and on the toner surface. The magnetite transfers heat by conduction to the toner resin polymer component until the polymer reaches its glass transition temperature($T_g$) for example at about 55° C. This causes the magnetite to, for example, sink in the glassy polymer and for the polymer to flow from the aforementioned peaks to the valleys to afford the resulting smoothed surface toner particle morphology. After the simultaneous high intensity blending and inductive heating the toner is discharged from the blender through discharge port(240) equipped with discharge value(250) to a product receiver or collection bin(260). Optionally the blend chamber can be adapted with a compressed gas flush line(not shown) to facilitate discharge and purging of the blend chamber. It is readily appreciated by one of ordinary skill in the art that the smoothed toner can be simultaneously or sequentially surface treated with a variety of known external surface additives while the toner particles are resident in the high intensity blend chamber. The resulting smoothed toner particles were analyzed as in Example I.

| | BET SA ($m^2/g$) | $D_{3,2}$ (microns) | Normalized Surface Area |
|---|---|---|---|
| Treated Toner | 1.36 | 7.01 | 2.80 |
| Control (non-heat-treated) | 1.53 | 6.91 | 3.11 |

This toner was subsequently blended with an external additive described in Example I and was measured for cohesion and compression ratio using the Hosokawa Powder Tester package as in Example I. The results indicate that the smoothed surface toner when blended with additives has a superior flow property compared to substantially the same but non-heat-treated control toner.

| | % Cohesion | Compression |
|---|---|---|
| Treated Toner | 5 | 0.30 |
| Control (non-heat-treated) | 12 | 0.33 |

A working developer was prepared as in Example I with substantially the same result.

EXAMPLE IV

Toner Preparation, Toner Smoothing, and Toner Classification

A toner composition was prepared in an extrusion device, available as ZSK92 from Werner-Pfleiderer, by adding thereto the identical ingredients and amounts as in Example I. The melt mixture was extruded, ground, and classified as in Example I, and the resulting toner particles analyzed.

Figure 3:
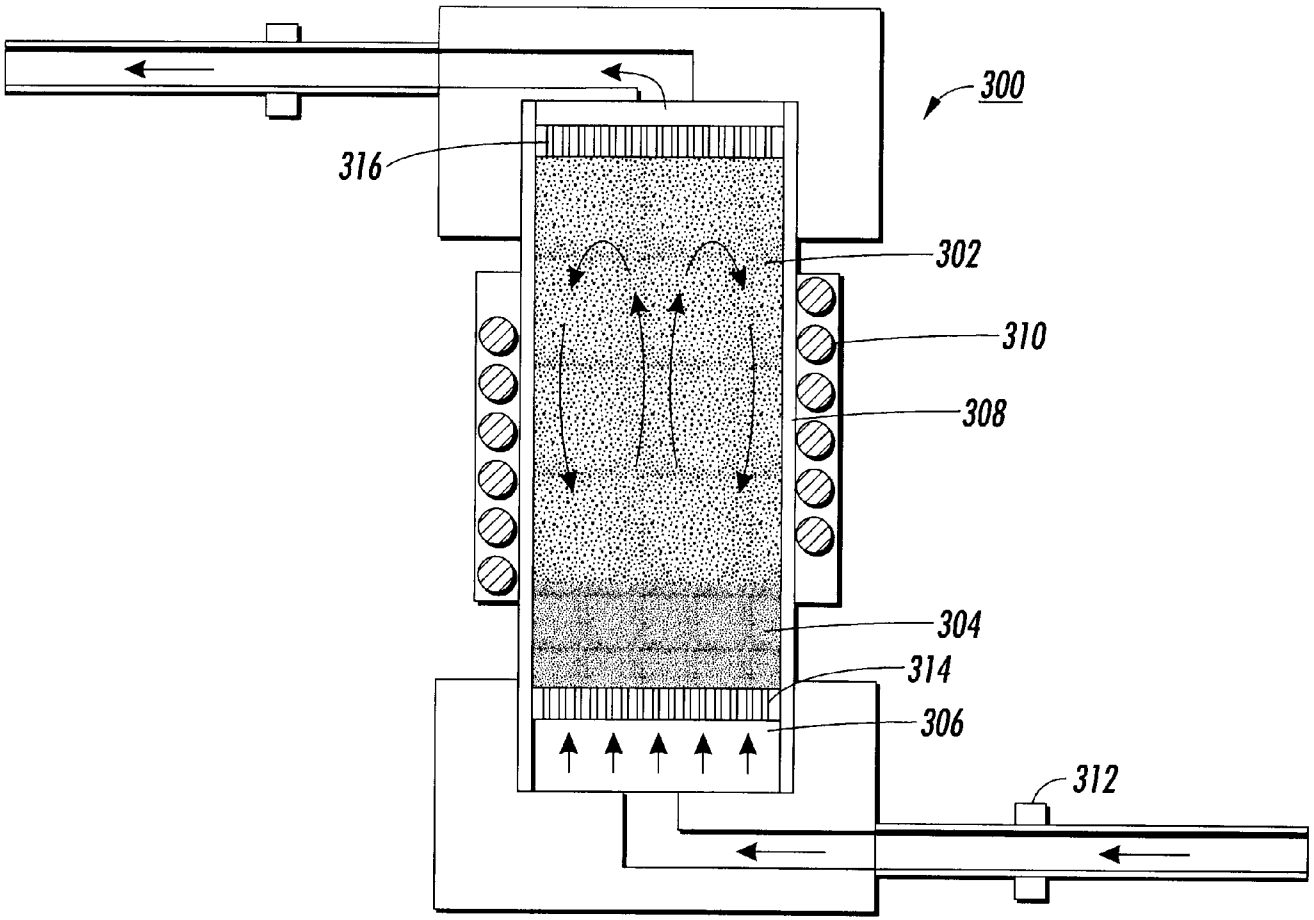
FIG. 3 illustrates in embodiments an apparatus of the present invention for preparing smooth surface toner particles.
Figure 4:
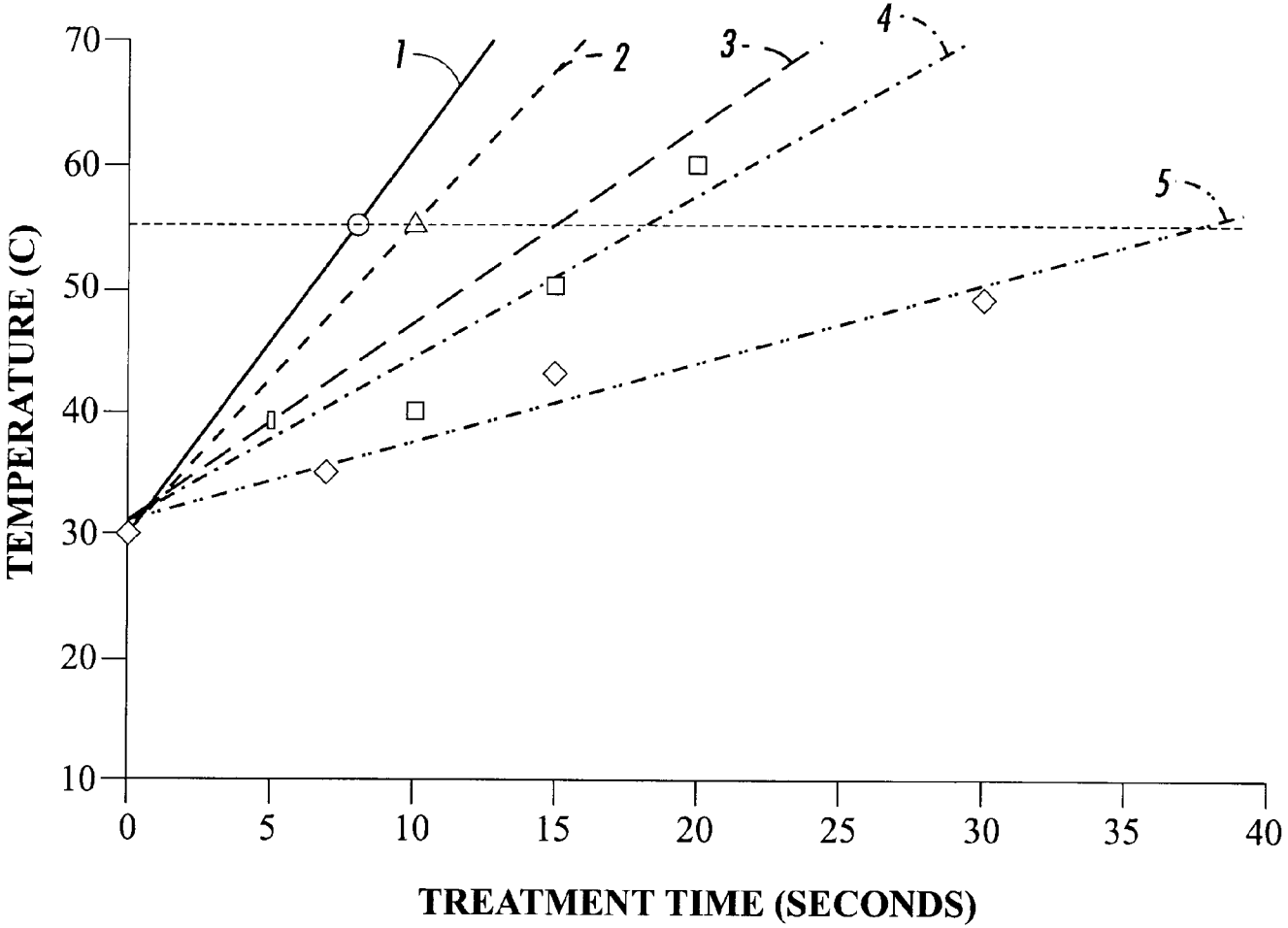
FIG. 4 illustrates in embodiments exemplary induction heating responses as a function of power input and time in an apparatus of the present invention.

Referring to, for example, FIG. 3, about 5 grams of the classified toner are placed in an inductively heated fluidizing apparatus(300) with a chamber(302) adapted to fluidize a charge of toner particles(304) with a compressed gas(306), such as air. The walls(308) of the chamber can be constructed of rigid material, for example, PLEXIGLASS® or a double walled vessel with a solid exterior wall and a porous interior wall made of, for example, POREX®, and which double walled vessel would permit continuous and uniform gas fluidization of the toner particles, and the induction heater coil(310) is situated to around the exterior of the chamber walls. Air can be injected into the fluidizing chamber, preferably from the bottom of the chamber, and the air flow rate can be regulated by, for example, a valve(312), to uniformly fluidized the toner or developer material within the chamber. A ceramic(5 microns) or similar porous membrane media(314), such as POREX® porous polymers, can be located at or near the bottom of the fluidizing chamber to uniformly admit gas to the chamber and, for example, a filter paper or similar porous membrane(316) can be placed at the top of the fluidizing chamber to prevent, for example, over sized material from prematurely escaping from the chamber. In all tests, a low frequency, for example, of about 50 to 60 Hz induction heating coil was used. Low frequency induction heating results in deeper penetration of the induced current in the material being smoothed. The induction heating heats the magnetite on the surface of the toner particle. As described above the magnetite in the toner material is inductively heated and thereafter transfers heat by conduction to the polymer until the polymer reaches its glass transition temperature ($T_g \cong 55°$ C.). This causes the magnetite to sink in the glassy polymer, resulting in a smoother surface morphology. The induction heating response as a function of power input and time is summarized, for example, in FIG. 4. Reference numerals 1, 2, 3, 4 and 5, are representative plots of time versus temperature as a function of corresponding maximum power levels of 95, 75, 50, 30 and 10 percent, respectively. It is readily evident from this Figure that lower power levels may be employed but generally necessitate longer induction heating or longer residence times of the toner in the heating zone to achieve comparable smoothing results.

In a preferred embodiment the toner particles were treated at, for example, about 95 percent maximum power for about 10 seconds in the fluidized bed. No fused polymer or toner buildup or residue was noted. After inductive heat treatment the toner particulates were removed from the chamber. The resulting smoothed toner particles were analyzed as in Example I with the following results.

| | BET SA ($m^2/g$) | $D_{3,2}$ (microns) | Normalized Surface Area |
|---|---|---|---|
| Treated Toner | 1.36 | 7.01 | 2.80 |
| Control (non-heat-treated) | 1.53 | 6.91 | 3.11 |

This toner was also subsequently blended with an external additive described in Example I and was measured for cohesion and compression ratio using the Hosokawa Powder Tester package as in Example I. The results indicate that the smooth surface toner when blended with additives has superior flow property compared to substantially the same but non-heat-treated toner.

| | % Cohesion | Compression |
|---|---|---|
| Treated Toner | 5 | 0.30 |
| Control (non-heat-treated) | 12 | 0.33 |

A working developer was prepared as in Example I with substantially the same result.

Other modifications of the present invention may occur to one of ordinary skill in the art based upon a review of the present application and these modifications, including equivalents thereof, are intended to be included within the scope of the present invention.

What is claimed is:

1. An apparatus comprising:

a grinder adapted to grind toner particles;

a classifier in communication with the grinder adapted to separate sized toner particles from unsized toner particles;

a conduit in communication with the classifier which conduit is adapted to convey the sized toner particles away from the grinder;

a heater adapted to heat and smooth the surface of the sized toner particles received from the conduit; and a particle separator adapted separate the resulting mixture of smooth surface toner particles and debris particles received from the heater.

2. An apparatus in accordance with claim 1, wherein the heater comprises a non contact induction heater which surrounds a portion of the conduit.

3. An apparatus in accordance with claim 2, wherein the heater further comprises a rotary tube interposed in the conduit.

4. An apparatus in accordance with claim 1, wherein the grinder is a fluidized jet mill.

5. An apparatus in accordance with claim 1, further comprised of at least one feed source of resin particles, magnetic pigment particles, or toner particles.

6. An apparatus in accordance with claim 1, wherein the particle separator comprises a first receiver for collecting the heavier smooth surface toner particles and a second receiver for collecting the lighter debris particles.

7. An apparatus in accordance with claim 1, wherein the heater heats at a temperature of from about 40 to about 500° C. as measured on the surface of the toner particles.

8. An apparatus in accordance with claim 1, wherein the heater heats the conveyed toner particles for from about 0.1 second to about 2 minutes.

9. A process, accomplished in the apparatus of claim 1, comprising:

grinding toner particles comprising a resin component and a magnetic pigment;

separating classified toner particles from the resulting ground particles;

transporting the separated classified toner particles and heating the separated classified toner particles with a non-contact induction heater surrounding at least a portion of the conduit to partially melt the resin component and causing the surface of the toner particles to smooth; and optionally isolating the resulting smooth surface toner particles.

10. A process in accordance with claim 9, wherein the resulting smooth surface toner particles have a Normalized Surface Area Ratio of from about 2.5 to about 2.9 compared to an Area Ratio of about 2.8 to about 3.25 for toner particles prior to heating.

11. A process in accordance with claim 9, further comprising blending the smooth surface toner particles with surface treated silica flow additives at about 1 weight percent to provide a Percent Cohesion value of from about 4 to about 6 compared to the Percent Cohesion value of about 9 to about 15 for non-heat treated toner particles with the same additives and in the same amounts.

12. A process in accordance with claim 9, further comprising blending the smooth surface toner particles with surface treated silica flow additives at about 1 weight percent to provide a Compression Ratio of about 0.30 compared to a Compression Ratio of about 0.33 for non-heat treated toner particles with the same additives and the same amounts.

13. A process in accordance with claim 9, further comprising blending the smooth surface toner particles with surface treated silica flow additives at about 1 weight percent to provide a triboelectric charging property of about 25 to about 27 for a two component developer at about a 3 weight percent toner concentration compared to a triboelectric charging property of about 21 to about 24 for non-heat treated toner particles with the same additives and in the same amounts.

14. A process in accordance with claim 9, further comprising accomplishing the transporting and heating of at least a portion of the toner particles in the presence of a magnetic brush structure.

15. A process in accordance with claim 9, wherein the relative weight ratio of the resin component to the magnetic pigment is from about 100:0.10 to about 1.0:10.0.

16. A process in accordance with claim 9, wherein the transporting of the separated classified toner particles is in an amount of from about 1 pound to about 10,000 pounds per hour.

17. A process in accordance with claim 9, wherein the toner particles comprise a resin comprised of a styrene n-butylacrylate and a magnetic pigment comprised of magnetite wherein the relative weight ratio of the resin to the magnetic pigment is from about 90:10 to about 35:65.

* * * * *